United States Patent [19]

Gargas

[11] Patent Number: 4,895,499

[45] Date of Patent: Jan. 23, 1990

[54] OUTLET VALVE ASSEMBLY FOR PAINT SPRAYER

[75] Inventor: Eugene F. Gargas, Wellington, Ohio

[73] Assignee: The Wooster Brush Company, Wooster, Ohio

[21] Appl. No.: 909,675

[22] Filed: Sep. 22, 1986

[51] Int. Cl.[4] ..... F04B 21/02; F04B 39/10

[52] U.S. Cl. ..... 417/506; 417/568; 137/539.5

[58] Field of Search ..... 417/31, 506, 568, 554; 137/539.5, 539

[56] References Cited

U.S. PATENT DOCUMENTS

| | | | |
|---|---|---|---|
| 2,941,475 | 6/1960 | Blair | 417/269 |
| 2,956,509 | 10/1960 | Cooprider et al. | 417/554 |
| 3,429,274 | 2/1969 | Nilsson | 417/568 |
| 4,393,895 | 7/1983 | Rubey | 137/539.5 |

*Primary Examiner*—Carlton R. Croyle

*Assistant Examiner*—Eugene L. Szczecina, Jr.

*Attorney, Agent, or Firm*—Renner, Otto, Boisselle & Sklar

[57] ABSTRACT

Outlet valve assembly for a paint sprayer and the like includes a spring stop engageable by the outlet valve during opening of the outlet valve to dampen the outlet valve movement during opening of the outlet valve. There is a slight initial clearance between the spring stop and outlet valve when the outlet valve is in the closed position. During each cycle of operation of the paint sprayer, the impact of the outlet valve striking the spring stop compresses the spring stop somewhat, whereby the distance between the spring stop and outlet valve when the outlet valve is in the closed position is less than when a rigid stop is used to obtain the desired amount of outlet valve travel during opening of the outlet valve. At the end of the delivery stroke of the pump, the force of the spring stop acting on the outlet valve pushes the outlet valve to the closed position.

19 Claims, 2 Drawing Sheets

OUTLET VALVE ASSEMBLY FOR PAINT SPRAYER

BACKGROUND OF THE INVENTION

This invention generally relates to an outlet valve assembly for controlling the discharge of fluid under pressure from a chamber, particularly a pumping chamber of a paint sprayer, and, more particularly, to such an outlet valve assembly which provides for reduced wear and increased life of the outlet valve without adversely affecting valve operation.

One form of paint sprayer in widespread use utilizes a diaphragm pump to draw paint or other fluid being pumped through an inlet valve assembly into a fluid chamber where the fluid is pressurized and discharged therefrom through an outlet valve assembly to a paint sprayer gun or the like.

The current state of the art outlet valve assembly for such a sprayer pump includes a light return spring and a fixed stop for limiting the travel of the outlet valve away from the valve seat during opening of the outlet valve. Such a fixed stop reduces the amount of time required to return the outlet valve to its fully seated or shut-off position prior to the start of the inlet stroke to minimize the back flow through the outlet valve, which is very important in obtaining optimum volumetric efficiency in such a sprayer pump.

Heretofore, the fixed stop was usually made of hardened steel or the like to reduce peening caused by the high speed and rapid impact of the outlet valve against the stop during the pumping operation. Typically, a sprayer pump of this type is driven by an electric motor which operates at approximately 1750 revolutions per minute (rpm). The resulting rapid impact of the outlet valve against the fixed stop, together with the abrasive particles in latex paint and the like, cause the rigid stop to wear and increase the distance that the outlet valve travels. Also, the impact of the outlet valve against the fixed stop may cause excessive wear of the outlet valve and cause the outlet valve to become out of round, resulting in increased leakage at the outlet valve and reduced pump efficiency.

SUMMARY OF THE INVENTION

The outlet valve assembly of the present invention overcomes the aforementioned drawbacks by utilizing in place of the rigid fixed stop, a spring stop which allows the distance between the outlet valve and spring stop to be less than when a rigid stop is used and still obtain the same desired amount of outlet valve travel during operation of the outlet valve.

In accordance with the present invention, the spring stop consists of a relatively stiff, high rate spring with a metal or plastic cap on the free end thereof for engagement by the outlet valve during each cycle of operation of the pump. The impact of the outlet valve striking the spring stop compresses the spring somewhat, whereby the distance between the spring stop and outlet valve when the outlet valve is in the seated (closed) position is less than when a rigid stop is used to obtain the same desired amount of outlet valve travel during opening of the outlet valve. Providing a shorter distance between the outlet valve and spring stop and using the spring stop to dampen the outlet valve movement greatly reduces the wear on the outlet valve for increased valve life, and reduces the noise created by engagement of the outlet valve with the spring stop. At the end of the delivery stroke of the pump, the force of the spring stop acting on the outlet valve pushes the outlet valve to the closed position.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
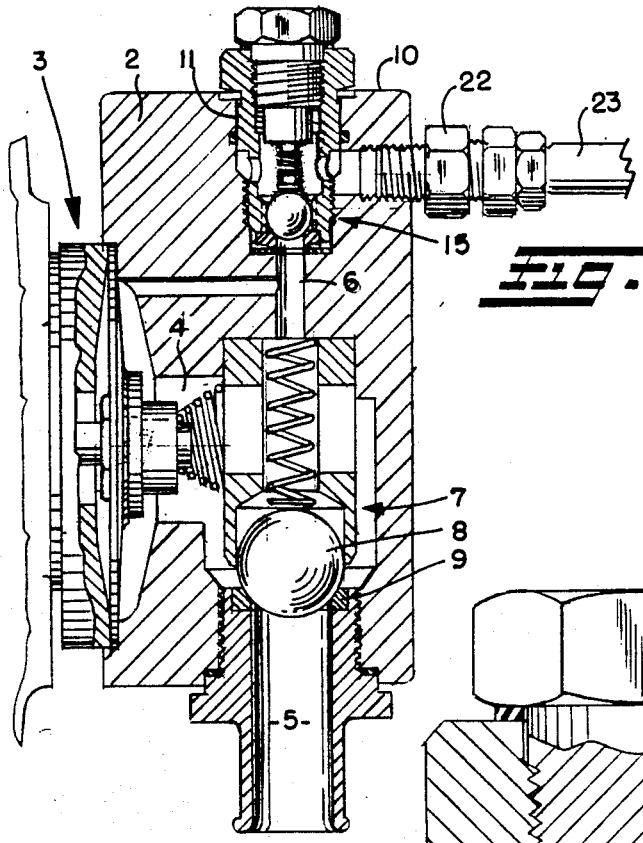
FIG. 1 is a fragmentary longitudinal section through one form of sprayer pump incorporating a preferred form of outlet valve assembly in accordance with this invention.

Referring now in detail to the drawings, and initially to FIG. 1, there is shown by way of example one type of paint sprayer 1 including a paint head 2 having a diaphragm pump 3 associated therewith for drawing paint or other fluid to be pumped into a pumping chamber 4 through an inlet opening 5 in the paint head during the inlet stroke and for discharging the fluid therefrom under pressure through an outlet opening 6 in the pump head during the outlet stroke. Associated with the inlet opening 5 is an inlet valve assembly 7 including an inlet valve 8 which is kept closed by gravity until the vacuum generated by the diaphragm movement on the inlet stroke lifts the inlet valve off the seat 9 to permit paint or other fluid to be drawn into the pumping chamber 4. Thereafter, the inlet valve 8 is forced shut by the fluid pressure which is generated in the pumping chamber during the outlet stroke.

Extending into the paint head 2 from an upper face 10 thereof in coaxial alignment with the outlet opening 6 is a stepped counterbore 11 in which is mounted a preferred form of outlet valve assembly 15 in accordance with this invention. As shown in greater detail in FIGS. 2 and 3, the outlet valve assembly 15 includes the usual outlet ball valve 16 that is kept closed in seated engagement with a valve seat 17 by gravity and the vacuum generated during the inlet stroke, and is opened by the fluid pressure generated in the pumping chamber 4 during the outlet stroke for discharge of the pumped fluid through a fluid discharge port 18 in the paint head 2 for flow through a connecting fitting 22 and paint hose 23 to a spray gun or the like (not shown). The outlet valve 16 and associated valve seat 17 are contained within a valve body 19 which may be threadedly received within the stepped counterbore 11. The valve body has an axial opening 20 in coaxial alignment with the valve seat 17, with axial splines 21 extending along the length of the opening 20 for guiding the outlet valve 16 by a close sliding but free fit with the inside diameter of the splines to keep the outlet valve centered with respect to the associated valve seat 17 and allow the paint or other fluid being pumped to pass freely around the outlet valve when the outlet valve is in the open position shown in FIG. 3. The centering of the outlet valve within the valve body reduces the time required for the outlet valve to find the sealing position in the valve seat 17 during closing of the outlet valve.

Figure 2:
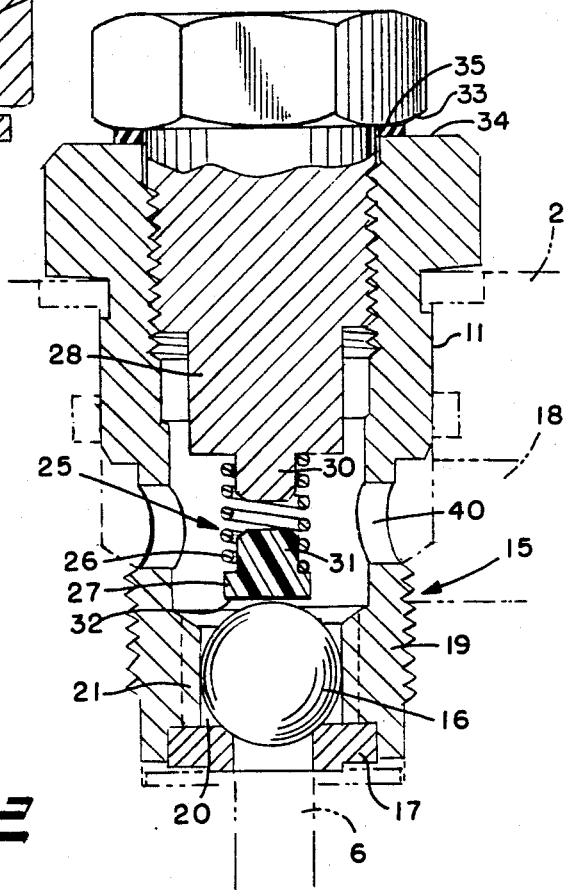
FIG. 2 is an enlarged fragmentary longitudinal section through the outlet valve assembly of FIG. 1 showing the outlet valve in the closed position.
Figure 3:
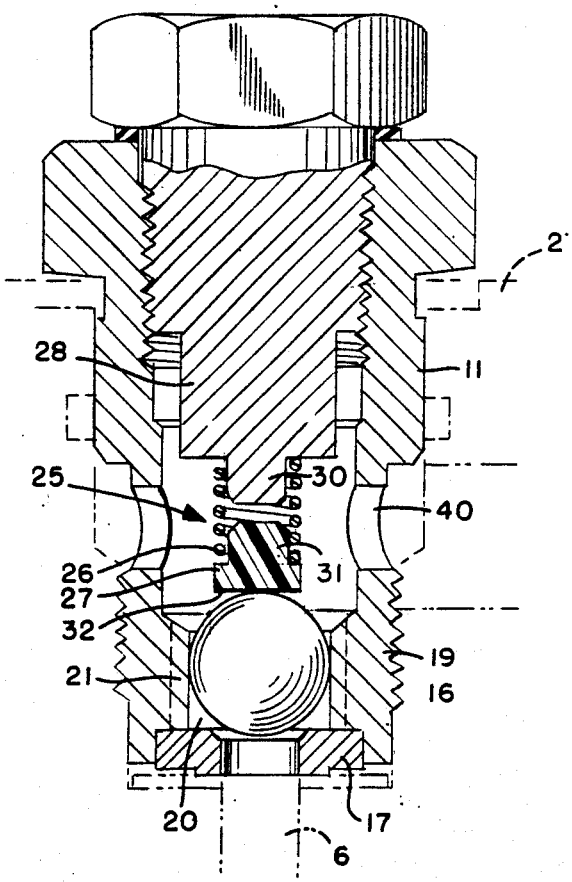
FIG. 3 is an enlarged fragmentary longitudinal section through the outlet valve assembly similar to FIG. 2 but showing the outlet valve in the open position.

To minimize the back flow through the outlet valve assembly 15, a spring stop 25 is provided within the valve body 19 for limiting the amount of travel of the outlet valve 16 away from the valve seat 17 during opening of the valve and thereby reduce the time required to return the outlet valve to its seated or shut-off position prior to the start of the inlet stroke. In the preferred form of the invention disclosed herein, the spring stop 25 consists of a relatively small, stiff, high rate spring 26, with a metal or plastic cap 27 at the free end thereof. The spring 26 may be mounted within the valve body 19 by attaching same to the inner end of a plug insert 28 threadedly receive in the outer end of the valve body. Both the plug insert 28 and cap 27 desirably have corresponding reduced diameter cylindrical end portions 30, 31 about which one or more turns of the opposite ends of the spring 26 are wrapped. The cylindrical end portions 30, 31 are tapered at their ends as shown in FIGS. 2 and 3, which causes the turns at opposite ends of spring 26 to expand and frictionally grip the cylindrical end portions 30, 31 by an interference fit therebetween during assembly of such spring ends onto such cylindrical end portions. Also, the cap 27 has a planar end face 32 which is impacted by the outlet valve 16 during opening of the outlet valve as described hereafter. The location of the plug insert 28 within the valve body 19 may be determined by providing overlapping shoulders 33, 34 thereon. Also, a suitable gasket 35 may be provided between such overlapping shoulders on the plug insert and valve body to prevent fluid leakage around the insert.

Such a spring stop 25 allows the initial clearance between the outlet valve 16 and spring stop when the outlet valve is fully closed as shown in FIG. 2 to be less than when a rigid stop is used and still obtain the desired amount of valve travel during opening of the outlet valve due to the limited compression of the spring 26 from the impact of the outlet valve striking the spring stop and particularly the cap 27 as shown in FIG. 3. Providing a shorter distance between the outlet valve and spring stop and using the spring stop to cushion or dampen the outlet valve movement greatly reduces the wear on the outlet valve for increased valve life. Also, the use of such a spring stop has the additional benefit that the noise created by engagement of the outlet valve with the spring stop during operation of the sprayer pump is reduced.

Although the specifications of the spring 26 may vary within certain limits, a preferred form of outlet valve assembly 15 in accordance with this invention includes a spring 26 made out of 0.040 inch diameter music wire having approximately six coils, of which approximately four are active and two are inactive. The spring has a spring rate of approximately 90 lbs. per inch, and has an outer diameter of approximately 0.248 inch, and a free length of approximately 0.375 inch.

When the outlet valve assembly 15 is mounted in the vertical position within the counterbore 10 and the outlet valve 16 is positioned by gravity against the valve seat 17 as shown in FIG. 2, preferably there is an initial clearance of approximately 0.006 inch between the outlet valve and adjacent surface (end face 32) of the spring stop cap 27. During each cycle of operation of the sprayer pump 1, the impact of the outlet valve 16 striking the spring stop cap 27 compresses the spring 26 somewhat to permit the desired travel of the outlet valve 16 a distance for example of approximately 0.030 inch (the initial clearance of approximately 0.006 inch plus a movement of the spring stop 25 of approximately 0.024 inch) to the fully open position shown in FIG. 3 for passage of the paint or other fluid being pumped through the outlet passage 6 and around the outlet valve and out through radial flow passages 40 in the valve body for discharge from the pump head 2 through the fluid discharge port 18 therein. When the outlet valve is in such full open position, the force of the spring 26 acting on the outlet valve 16 is desirably approximately 2.2 lbs, which is sufficient to push the outlet valve to the fully seated (closed) position shown in FIG. 2 at the end of the outlet stroke.

From the foregoing, it will now be seen that the outlet valve assembly of the present invention includes a spring stop that allows the distance between the outlet valve and spring stop to be less than if a rigid stop were used while still obtaining the desired amount of outlet valve travel during opening of the outlet valve to reduce the wear and increase the life of the outlet valve without adversely affecting outlet valve operation. Also, the use of the spring stop has the added benefit that the sprayer noise is decreased.

Although the invention has been shown and described with respect to a certain preferred embodiment, it is obvious that equivalent alterations and modifications will occur to others skilled in the art upon the reading and understanding of the specification. The present invention include all such equivalent alterations and modifications and is limited only by the scope of the claims.

I claim:

1. An outlet valve assembly for a paint sprayer or the like having a pumping chamber and inlet and outlet openings through which fluid is respectively drawn into the pumping chamber and discharged therefrom, said outlet valve assembly comprising a valve seat adapted to be received in said outlet opening, an outlet valve movable toward and away from said valve seat for respectively closing and opening said outlet opening, and spring stop means engageable by said outlet valve during opening of said outlet valve to dampen the outlet valve movement during opening of said outlet valve, said spring stop means and outlet valve having a slight clearance space therebetween when said outlet valve is in the closed position in seated engagement with said valve seat, said spring stop means comprising spring means for limiting the maximum amount of movement of said outlet valve away from said valve seat during opening of said outlet valve to its fully position during full operating conditions.

2. The outlet valve assembly of claim 1 wherein the clearance space between said spring stop means and outlet valve when said outlet valve is in the closed position is approximately 0.006 inch.

3. The outlet valve assembly of claim 1 wherein said spring means comprises a relatively stiff, high rate spring.

4. The outlet valve assembly of claim 3 wherein said spring has a spring rate of approximately 90 lbs. per inch.

5. The outlet valve assembly of claim 3 wherein said spring stop means further comprises a cap on the end of said spring nearest said outlet valve which is engaged by said outlet valve during opening of said outlet valve.

6. The outlet valve assembly of claim 3 further comprising a valve body adapted to be threadedly received in said outlet opening, said valve body containing said outlet valve and valve seat and having a removable insert therein, and means for attaching said spring to said removable insert.

7. The outlet valve assembly of claim 6 wherein said insert is threadedly received in said valve body.

8. The outlet valve assembly of claim 7 wherein said spring has one end attached to said insert and the other end extending toward said outlet valve and in coaxial alignment therewith.

9. The outlet valve assembly of claim 8 wherein said spring stop means further comprises a cap on said other end of said spring which is engaged by said outlet valve during opening of said outlet valve, said cap and insert having a clearance space therebetween when said outlet valve is in its fully open position.

10. The outlet valve assembly of claim 9 wherein said insert and cap have corresponding reduced diameter cylindrical end portions about which the opposite ends of said spring are wrapped for frictional engagement therewith.

11. The outlet valve assembly of claim 6 wherein said valve body has axial splines for guiding said outlet valve and keeping said outlet valve centered with respect to said valve seat during opening and closing of said outlet valve, said splines allowing fluid flow around said outlet valve when said outlet valve is in the open position.

12. A sprayer pump for a paint sprayer and the like comprising a pumping chamber having inlet and outlet openings, pump means for drawing fluid into said pumping chamber through said inlet opening and for discharging such fluid from said pumping chamber under pressure through said outlet opening, and inlet and outlet valve assemblies for respectively controlling the flow of fluid into said pumping chamber through said inlet opening and out through said outlet opening, said outlet valve assembly comprising a valve seat in said outlet opening, an outlet valve positioned by gravity against said valve seat for closing said outlet opening, said outlet valve being movable upwardly away from said valve seat by fluid pressure in said pumping chamber for discharge of the pressurized fluid therefrom through said outlet opening, and spring stop means positioned above said outlet valve in coaxial alignment therewith for dampening the outlet valve movement during opening of said outlet valve, said spring stop means and outlet valve having a relatively small clearance space therebetween when said outlet valve is in seated engagement with said valve seat, said spring stop means comprising spring means for limiting the maximum amount of movement of said outlet valve away from said valve seat during opening of said outlet valve to its fully open position during full operating conditions.

13. The sprayer pump of claim 12 wherein there is an initial clearance space of approximately 0.006 inch between said outlet valve and spring stop means when said outlet valve is in seated engagement with said valve seat.

14. The sprayer pump of claim 13 wherein the spring rate of said spring stop means is such that the impact of said outlet valve striking said spring stop means during each cycle of operation of said pump means causes said spring stop means to be compressed approximately 0.024 inch, whereby the overall travel of said outlet valve during opening of said outlet valve is approximately 0.030 inch.

15. The sprayer pump of claim 14 wherein said spring means comprises a spring having a spring rate of approximately 90 lbs. per inch.

16. The sprayer pump of claim 12 wherein said spring stop means further comprises a cap on the end of said spring means nearest said outlet valve which is engaged by said outlet valve during opening of said outlet valve.

17. The sprayer pump of claim 12 wherein said outlet valve assembly further comprises a valve body threadedly received in said outlet opening, said valve body containing said outlet valve and valve seat, and a removable insert in said valve body which supports said spring stop means within said valve body.

18. The sprayer pump of claim 17 wherein said spring means comprises a spring having one end attached to said insert and the other end extending toward said outlet valve and in coaxial alignment therewith, and a cap on said other end of said spring which is engaged by said outlet valve during opening of said outlet valve, said cap and insert having a clearance space therebetween when said outlet valve is in its fully open position.

19. The sprayer pump of claim 18 wherein said insert and cap have corresponding reduced diameter cylindrical end portions about which the opposite ends of said spring are wrapped for frictional engagement therewith.

* * * * *